United States Patent [19]

Haraden et al.

[11] 4,156,901

[45] May 29, 1979

[54] PROJECTION UNIT HAVING REMOVABLE RETENTION MEMBER

[75] Inventors: Thomas Haraden, Ipswich; Harold L. Hough, Beverly, both of Mass.

[73] Assignee: GTE Sylvania Incorporated, Stamford, Conn.

[21] Appl. No.: 829,793

[22] Filed: Sep. 1, 1977

[51] Int. Cl.[2] ..... F21V 7/00

[52] U.S. Cl. ..... 362/296; 362/306; 362/341; 362/350; 362/457

[58] Field of Search ..... 362/16, 296, 306, 341, 362/350, 457

[56] References Cited

U.S. PATENT DOCUMENTS 3,789,212 1/1974 Wagner ..... 362/306

*Primary Examiner*—Stephen J. Lechert, Jr.

*Attorney, Agent, or Firm*—Lawrence R. Fraley

[57] ABSTRACT

An improved projection unit which comprises a glass reflector, incandescent lamp (e.g. tungsten halogen), and means for maintaining the lamp in established alignment within the reflector. The alignment means includes a retention member which clamps the sealed end portion of the lamp and is designed for rotative positioning within the reflector's neck portion. The retention member and lamp are removable and permit facile replacement thereof.

12 Claims, 5 Drawing Figures

PROJECTION UNIT HAVING REMOVABLE RETENTION MEMBER

BACKGROUND OF THE INVENTION

The invention relates to incandescent lamp and glass reflector combinations for use in projection systems such as 16 mm. movie projectors.

In known projection units which include a preformed glass reflector and projection lamp (e.g. tungsten halogen) therein, the lamp is retained in alignment with the reflector by employing a suitable cement (e.g. sauereisen) within the reflector and about the lamp's sealed end. Examples of such arrangements are shown in U.S. Pat. Nos. 3,314,331 (Wiley) and 3,639,750 (Anthonijsz). Use of cement or a similar permanent-type bonding agent prohibits separation of the lamp and reflector in the event that replacement of either of these components is necessary. In almost all cases, it is only the incandescent lamp which fails and needs replacement.

The aforementioned permanent bond between lamp and glass reflector was heretofore believed essential to assure precise alignment between said components and between these members and other elements (e.g. film gate, projection lens) within the overall system. Alignment between reflector and lamp was usually achieved using a precisioned instrument whereupon the assembled unit was ready for insertion within a respective socket-holder arrangement, such as shown in U.S. Pat. No. 3,789,212 (Wagner). This latter positioning is usually accomplished by the projector's operator.

Required replacement of both lamp and reflector therefor results in an unnecessary waste of material which in turn adds appreciably to the overall cost of operating the system.

It can therefore be seen that a projection unit which permits removal of the lamp from the unit's glass reflector to in turn permit replacement of only the lamp while still assuring the precisioned alignment between lamp and reflector and lamp-reflector and other elements of the system would constitute a significant advancement in the art.

OBJECTS AND SUMMARY OF THE INVENTION

It is therefore a primary object of the invention to enhance the projection art by providing a projection unit which readily permits separation of the unit's glass reflector and projection lamp components.

In accordance with one aspect of the invention, an improved projection unit is provided which includes a glass reflector, an incandescent projection lamp, and alignment means for maintaining the lamp and reflector in predetermined alignment. The alignment means comprises a retention member which engages and retains the sealed end of the lamp and which is readily removable from the neck portion of the reflector.

DETAILED DESCRIPTION OF THE PREFERRED EMBODIMENTS

For a better understanding of the present invention together with other and further objects, advantages and capabilities thereof, reference is made to the following disclosure and appended claims in connection with the above described drawings.

Figure 1:
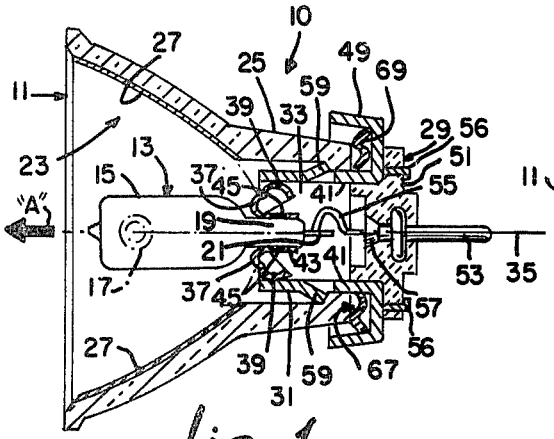
FIG. 1 is a side view, in section, of one embodiment of the invention.

In FIG. 1 there is shown an improved projection unit 10 in accordance with one embodiment of the invention. As stated, unit 10 is particularly adapted for use within a projection system such as an 16 mm. movie projector. Accordingly, projection unit 10 would be located within a suitable socket-holder assembly (not shown) such as described and shown in the aforementioned U.S. Pat. No. 3,789,212. Projection unit 10 includes a glass reflector 11 and an incandescent projection lamp 13 located within the reflector. A preferred lamp 13 for use with the invention is one of the tungsten-halogen variety and which produces 200 watts at a potential of 24 volts. Lamps of this type are known in the art and are typically rated for 50 hours of operation. Lamp 13 includes an envelope portion 15 having a filament structure 17 (e.g. tungsten) therein. The lamp further includes a press-sealed end portion 19 having a plurality (e.g. two) of electrical contact wires 21 extending therefrom. Usually, wires 21 are of molybdenum or similar conductive material.

Reflector 11 includes a concave reflecting portion 23 and a hollow neck portion 25 adjacent thereto. Concave portion 23 is preferably elliptical and includes a thin dichroic internal layer or coating 27. Accordingly, reflector 11 permits much of the heat generated by lamp 13 to pass therethrough while still directing the lamp's visible light output in a forward direction ("A") in FIG. 1.

As earlier stated, alignment between lamp 13 and reflector 11 is extremely critical in order to assure optimum forward output of unit 10. Understandably, alignment is also critical between unit 11 and the remaining elements of the overall projection system, such as the projector's film gate and projection lens. Such elements are well known in the prior art and are not illustrated here. To maintain the above critical alignment, it was heretofore considered necessary to employ a permanent bond between the lamp and reflector components of the system, particularly when utilizing a glass reflector. This bond was achieved by using a suitable cement (e.g. sauereisen) within the reflector's neck portion. The sealed end of the lamp was thus affixed within the material.

The present invention eliminates the above requirement by providing an alignment means 29 which positively engages (e.g. via clamping) the sealed end 19 of lamp 13 to retain it within the hollow neck portion 25 of reflector 11. As will be understood, means 29 is readily removed from neck 25 to assure facile replacement of only lamp 13 should the lamp become inoperative.

Means 29 comprises a retention member 31 which aligns lamp 13 such that envelope portion 15 is oriented within concave portion 23 of reflector 11 and the lamp's sealed end 19 is located substantially within neck 25. Member 31 defines an opening 33 therein in which is located sealed end 19 and extending wires 21 of lamp 13.

Figure 5:
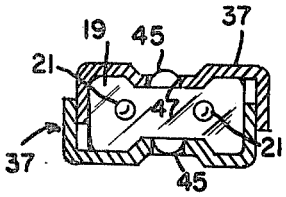
FIG. 5 is an enlarged end view, partly in section, of the sealed end portion of the lamp of FIG. 1.

Lamp 13 is retained such that filament structure 17 lies on the central axis 35 of reflector 11 and in the focus of the ellipse of reflector 11. In accordance with one embodiment of the invention, this retained alignment is provided by using at least one clip member 37 (two are shown in FIG. 1). Clips 37 each include a domed portion 39 which engages the internal walls 41 of member 31. Domed portions 39, being metallic, are of sufficient thickness to assure a minor degree of resilience for clips 37. It is understood, however, that once projection unit 10 has been fully assembled, it is not possible to readily move (e.g. wobble) lamp 13 within the assembly. In other words, the present arrangement assures a positive degree of stiffness in order to maintain the required alignment between the lamp and reflector components. Portions 39 are preferably affixed (e.g. by welding) to walls 41. Each clip further includes a clamping segment 43 which clamps about end 19 in the manner shown. To facilitate this retention, end 19 includes a pair of opposing upstanding button portions 45 and each segment 43 includes an opening 47 to accommodate a respective button. FIG. 5, an enlarged end view of the sealed end portion 19 of lamp 13, clearly illustrates the overlapping positioning arrangement of clips 37. The upstanding buttons 45 of end 19 are also shown, as are the openings 47 (2) in each of the clips 37 to accommodate a respective button 45.

In the embodiment of FIG. 1, retention member 31 and clips 37 are preferably metallic (e.g. 24 ga. steel). Member 31 further includes a flanged end portion 49 which protrudes beyond the end of neck portion 25. An insulative (e.g. ceramic) member 51 is positioned within flanged end 49 and extends within opening 33. Two contact pins 53, one for each wire 21, are rigidly positioned within member 51 and are electrically joined to wire 21 via resilient interconnecting segments 55. In another embodiment of the invention, segments 55 are omitted and wires 21 directly connected to pins 53. Insulative member 51 is preferably staked within flanged portion 49 using tabs 56 which protrude from portion 49. (See also the embodiment of FIG. 3). It is also preferred to stake contact pins 53 within member 51. In this case, the pins would be located and one end (57 in FIG. 1) staked. It may also be possible to form ceramic member 51 about the contact pins.

Figure 2:
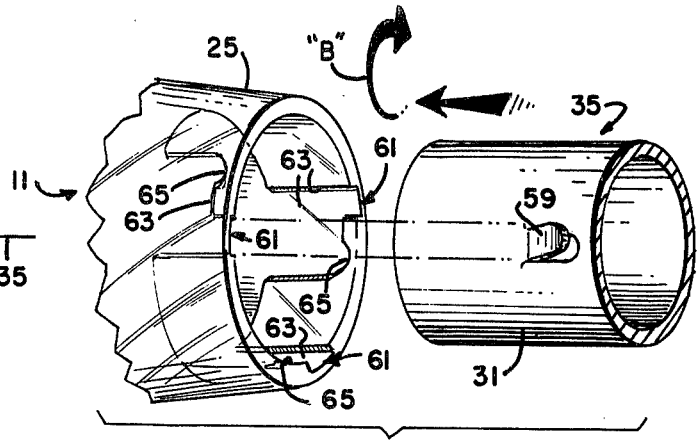
FIG. 2 is an isometric view depicting a preferred positioning arrangement between the reflector and alignment means of the invention.

Alignment means 29, having lamp 13 securedly retained herein, is inserted into reflector 11 through neck portion 25. As illustrated in FIG. 2, retention member 31 includes at least one upstanding tab member 59 therein. Neck portion 25 of the glass reflector includes at least one groove 61 formed therein with which tab 59 is aligned. It is preferred in the present invention to utilize three upstanding tabs 59 spacedly located about member 31. Accordingly, three grooves 61, one for each tab, are also used. (Lamp 13 is excluded from FIG. 2 for clarification purposes). When using three tabs 59, it is preferred to space the tabs at different intervals about the cylindrical member 31 to assure "one-way" insertion and repeatability. In one embodiment, these three intervals are 110°, 120°, and 130°, respectively. It is understood that the corresponding alignment grooves 61 are similarly spaced about neck 25.

Means 35 and lamp 13 are inserted into neck portion 25 afterwhich the retention member 31 is rotated until the lamp and means are locked in place. In the embodiment of FIG. 2 this rotation is clockwise (direction "B") within the stationary reflector 11. Locking is accomplished when the tabs 59, having slidably engaged the internal sides 63 of neck portion 25 which define grooves 61, align with and are forced into corresponding indentations 65. The force necessary to achieve this locking is provided by a biasing means 67 (shown in FIG. 1) which maintains a continuous pressure against flanged portion 49. Biasing means 67 is preferably an annular spring washer 69 positioned between and in engagement with flanged end 49 and the end of neck portion 25. It should be noted that the ends of tabs 59 are rounded as are the corresponding indentations 65 in which these ends rest. This arrangement assures positive, accurate seating of member 31.

Figure 3:
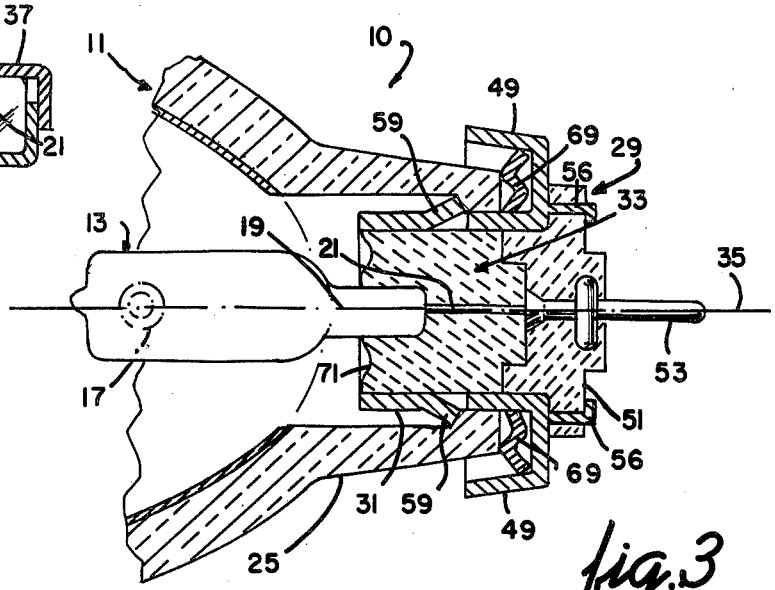
FIG. 3 is a partial side view, in section, of another embodiment of the invention.

In FIG. 3 is shown a projection unit 10 in accordance with an alternate embodiment of the invention. Unit 10 comprises the same reflector 11 and incandescent projection lamp 13 as the unit of FIG. 1. Alignment means 29 includes retention member 31 which is also inserted through neck portion 25 and thereafter rotatively oriented and locked within the neck. Means 29 differs from the previous example by the omission of clip members 37. Instead, the sealed end portion 19 of lamp 13 is rigidly secured within opening 33 of member 31 by a suitable ceramic cement 71 (e.g. sauereisen). Extending wires 21 are also located within cement 71 and are electrically connected directly to pins 53. A ceramic insulative member 51 is also used as well as the biasing spring washer 69.

Figure 4:
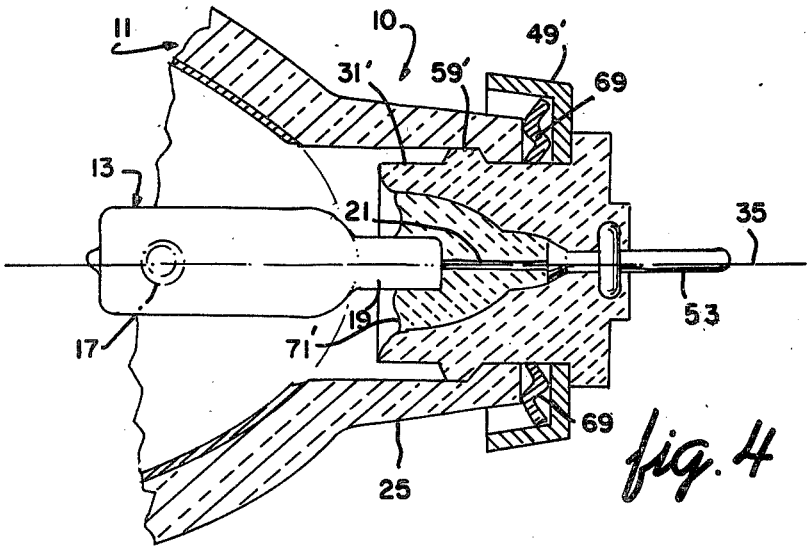
FIG. 4 is a partial side view, in section, of still another embodiment of the invention.

In the embodiment of FIG. 4, unit 10 utilizes an insulative (e.g. ceramic) retention member 31′ which includes upstanding members 59′ thereon. Members 59′ align with and slidably engage respective preformed grooves within neck portion 25 of the glass reflector 11 in much the same manner as the units of FIGS. 1 and 3. A suitable ceramic cement 71′ is used to secure end 19 of lamp 13 in the required alignment so that filament 17 lies on central axis 35. The extending wires 21 of lamp 13 are directly joined to pins 53. The metallic flanged member 49′ is located about the ceramic retention member 31′ while the aforedescribed annular spring washer provides the necessary biasing force.

Removal of any of the above alignment means and retained lamp is accomplished by depressing the positioned assembly until tabs 59 (or upstanding members 59′) are withdrawn from the respective indentations 65. The assembly is then rotated counterclockwise until the tabs and grooves (61) align and the assembly can be removed.

Thus there has been shown and described an improved projection unit which permits disassembly of the unit so that a defective lamp can be readily removed and replaced. The invention assures that the critical alignment between lamp and reflector will be maintained despite continuous lamp insertion and removal. The invention also represents a unique concept in glass reflector design by providing suitable grooves within the glass component which are able to accept metallic or ceramic retention members located therein.

While there have been shown and described what are at present considered the preferred embodiments of the invention, it will be obvious to those skilled in the art that various changes and modifications may be made therein without departing from the scope of the invention as defined by the appended claims.

What is claimed is:

1. In a projection unit including a glass reflector having a concave reflecting portion and a neck portion adjacent thereto, an incandescent projection lamp including an envelope portion having a filament therein and a sealed end portion adjacent said envelope portion, and alignment means for maintaining said projection lamp in established alignment within said glass reflector whereby said envelope portion will be located within said concave portion of said reflector and said sealed end portion will be located within said neck portion, the improvement wherein said alignment means comprises:

a retention member, said retention member positively engaging and retaining said sealed end portion of said lamp within said neck portion of said glass reflector, said retention member readily removable from within said neck portion.

2. The improvement according to claim 1 wherein said retention member is rotatively positioned within said neck portion of said glass reflector.

3. The improvement according to claim 2 wherein said neck portion of said glass reflector has at least one groove therein and said retention member includes means for aligning with said groove during said rotative positioning therein.

4. The improvement according to claim 3 wherein said means for aligning with said groove comprises at least one upstanding member, said member slidably engaging the sides of said groove during said rotative positioning.

5. The improvement according to claim 4 including biasing means adjacent the end of said neck portion of said glass reflector for biasing said retention member in a direction away from said glass reflector.

6. The improvement according to claim 4 wherein said retention member is comprised of a material selected from the group consisting of metal and ceramic.

7. The improvement according to claim 5 wherein said biasing means comprises an annular spring washer and said retention member includes a flange portion, said spring washer located between and in engagement with said end of said neck portion and said flange portion.

8. The improvement according to claim 2 wherein said retention member defines an opening therein, said sealed end portion of said projection lamp located within said opening.

9. The improvement according to claim 8 further including an insulative member securedly positioned within said opening of said retention member and including at least two contact pins projecting therefrom, said sealed end portion of said projection lamp including at least two contact wires extending therefrom, each of said contact wires electrically connected to a respective one of said contact pins.

10. The improvement according to claim 8 further including at least one substantially resilient clip member for interconnecting the internal walls of said opening within said retention member and said sealed end portion of said projection lamp.

11. The improvement according to claim 8 further including a quantity of cement within said opening of said retention member, said sealed end portion of said lamp fixedly positioned within said cement.

12. The improvement according to claim 10 wherein said clip member is affixed to said internal walls of said retention member.

* * * * *